United States Patent [19]

Hamanaka et al.

[11] Patent Number: 4,596,129

[45] Date of Patent: Jun. 24, 1986

[54] APPARATUS FOR FORMING FINS FOR HEAT EXCHANGERS

[75] Inventors: Ryomyo Hamanaka; Michio Fujimoto, both of Takasago, Japan

[73] Assignee: Mitsubishi Jukogyo Kabushiki Kaisha, Tokyo, Japan

[21] Appl. No.: 544,997

[22] Filed: Oct. 24, 1983

[30] Foreign Application Priority Data

Nov. 1, 1982 [JP] Japan ..... 57-190738
Dec. 7, 1982 [JP] Japan ..... 57-213409
Dec. 10, 1982 [JP] Japan ..... 57-215531

[51] Int. Cl.[4] ..... B21D 53/04
[52] U.S. Cl. ..... 72/187; 72/198
[58] Field of Search ..... 72/187, 196, 198, 186, 72/191; 29/157.3 R, 157.3 A, 157.3 B, 157.3 C

[56] References Cited

U.S. PATENT DOCUMENTS 2,549,466 4/1951 Hoheisel ..... 29/157.3 R
2,971,558 2/1961 Vicknair, Jr. ..... 72/196

*Primary Examiner*—Lowell A. Larson
*Attorney, Agent, or Firm*—Birch, Stewart, Kolasch & Birch

[57] ABSTRACT

An apparatus, for forming fins for heat exchangers, comprising a pair of rolls which are provided, on the outer peripheral surfaces thereof, with grooves of a pattern corresponding to the shape of the fins to be formed therebetween and which form them by pressing the fins from opposite sides thereof with the aid of the synchronous rotation of the rolls to give smooth curved outer surfaces thereon, characterized in that the grooves on the rolls are formed so that each groove may be composed of a bottom portion having a substantially arcuate shape and a tapered portion converging from the outer peripheral surface toward the bottom portion of the roll as viewed in section, and at least one roll of the pair of rolls is provided with an urging means for pressing the aforesaid roll against the other roll at a constant pressure. An apparatus for forming needle fins for heat exchangers characterized by providing a means for alternately oppositely bending the fins which have been formed to be possessed of the curved outer surfaces. An apparatus for forming needle fins for heat exchangers characterized by further successively providing an arrangement forming roll area on a downstream side of the fin section forming roll area.

3 Claims, 19 Drawing Figures

APPARATUS FOR FORMING FINS FOR HEAT EXCHANGERS

The present invention relates to an apparatus for forming fins for heat exchanger.

Heat exchangers are devices for transferring heat energy from a high-temperature fluid to a low-temperature fluid through a barrier in order to accomplish heating or cooling. According to a constructive classification of heat exchangers, there can be mentioned the fin-pipe type heat exchanger. In the case that a gas is allowed to flow along the outer side of a heat transfer pipe, the fin-pipe type heat exchanger may be employed in which the fins are fixed to the surfaces of the heat transfer pipe so as to increase the heat flux, since a heat transfer efficiency between the heat transfer pipe and the gas is low.

Examples of the fin-pipe type heat exchanger are mentioned below:

One example is shown in FIGS. 1 to 5 attached hereto, wherein FIG. 1 is an elevational view of the heat exchanger, FIG. 2 is a sectional view taken along line A—A in FIG. 1, FIG. 3 is an enlarged view of a part B in FIG. 2, FIG. 4 is a sectional view taken along line C—C in FIG. 3, and FIG. 5 is a perspective view of a needle fin. This type of heat exchanger comprises a hairpinned flat refrigerant pipe 1 and corrugated needle fins 2 having cutout portions 2*a*, with the fins 2 being disposed between flat surfaces 1*a* of the refrigerant pipe 1 so that the cutout portions 2*a* and the flat surfaces 1*a* may intersect at substantially right angles, with edge portions 2*b* of the fins 2 being joined to the flat surfaces 1*a*. The interior refrigerant pipe 1 is divided into sections by partitions 1*b*. Further, for the sake of making, smooth, the flow of a gas in the direction of the arrow in FIG. 4, no needles are provided at positions 6 of the fins 2, and large cutout portions 2*a*′ are thus prepared at this location.

FIGS. 6 and 7 show a fin-pipe type heat exchanger in which, in place of the above-mentioned needle fins, expanded metal screens are used as the fin members. FIG. 6 corresponds to FIG. 3 referred to above, and FIG. 7 is an enlarged view of a part D in FIG. 6. The expanded metal screens 3 are corrugated and joined to the refrigerant pipe 1. The constitution of the expanded metal screens is achieved by the integral combination of strand portions 3*b* and bond portions 3*a*.

In these fin-pipe type heat exchangers, if the needles or needle fins 2*c* and the strand portions 3*b* are rectangular and angular in their sectional configuration, the gas flowing between the needles 2*c* or the strand portions 3*b* will be turbulent, which fact will lead to a greater pressure loss of the gas, an occurrence of noise, a drop in the flow velocity of the gas and a deterioration in heat transfer efficiency.

For this reason, an attempt has been made to form the needles or the strand portions into the shape of a circle or ellipse as viewed in section, with the aim of providing smooth curving outer peripheral surfaces.

For example, in the case that the fin member 2 shown in FIGS. 1 to 5 is manufactured, the cutout portions 2*a* are punched at predetermined intervals in a plate material, and the needles 2*c* are then formed into a circular shape as viewed in section. For this formation, an apparatus as exhibited in FIG. 8 has heretofore been used. This apparatus comprises a pair of rolls 5, 5′ which have, on the outer peripheries thereof, half-rounded grooves 4, 4′ corresponding to the needles 2*c* of the fin 2 and which are disposed confronting each other, with the fin 2 being introduced between the grooved-rolls 5, 5′. When needles 2*c* having a rectangular shape as viewed in section are pressed by the upper and lower rolls 5, 5′, the needles 2*c* will be successively formed from rectangles into circles in the sectional configuration.

In the case of this apparatus, however, provided that the needles of the fin deviate from the half-round grooves on the grooved-rolls, the needles will not be formed into a circle, as viewed in section, but will be crushed into a flat shape and such a deviation of the needle fins cannot be liquidated automatically. Further, when a hard foreign particle finds it way between the grooves-having rolls at the time of the occurrence of such a deviation, it is feared that the needle will be cut by the foreign particle.

The present invention has been directed to overcoming such a drawback, and its object is to provide an apparatus, for forming fins for heat exchangers, which can ensure that the needles of the fins or the strands of the expanded metal screens are formed into a circular or an elliptic shape in their sectional configuration.

For the achievement of the object above, according to the present invention, there is provided an apparatus, for forming fins for heat exchangers, having a pair of rolls which are provided, on the outer peripheral surfaces thereof, with grooves having a pattern corresponding to the shape of the fins and which form the fins by pressing the fins from opposite sides thereof with the aid of a synchronus rotation of the rolls to provide a smooth curved outer surfaces thereto.

If an attempt is made to further reduce the pressure loss and to improve the heat exchange efficiency, it will be advantageous to form the needle fins 2*c* into a circular shape in their sectional configuration and to displace them in an alternate and opposite style in a direction crossing the fin 2, as shown in FIG. 13 corresponding to FIG. 4.

Another object of the present invention is to provide an apparatus, for forming fins for heat exchangers, which can manufacture the corrugated fin as shown in FIG. 13.

For the achievement of this object, according to the present invention, there is provided an apparatus, for forming fins for heat exchangers, which is provided with a pair of forming rolls for plastically forming the needle fins from a rectangular into a circular configuration as viewed in section by pressing the fins from opposite sides thereof with the aid of mutual synchronous rotation of the forming rolls, characterized in that the pair of forming rolls is provided, an outer peripheries thereof, with mutually engaging teeth, respectively. Outwardly divergent arcuate grooves are disposed on a top of the tooth and along a tooth ridge thereof. The bottom portions of the teeth are formed into an arcuate shape, whereby the needle fins are formed into a round shape as viewed in section by nippingly pressing them between the bottom portions and the arcuate grooves and are simultaneously bent alternately, oppositely in a direction crossing the fins.

A further object of the present invention is to provide an apparatus, for forming fins for heat exchangers, in which both steps of independently carrying out the formation and the bending of the fins are arranged in tandem with the intention of improving the forming accuracy and the speed-up of forming operation, in contrast with the above-mentioned manufacturing device wherein the formation and the arrangement of the fins are simultaneously carried out.

For the achievement of the instant object, according to the present invention, there is provided an apparatus, for manufacturing fins for heat exchangers, in which a ladder-like blank is fed between the mutually engaging forming rolls, characterized in that an arrangement forming roll area is continuously provided on the downstream side of the fin section forming roll area, and the rolls in the fin section forming roll area have, on the surfaces thereof, teeth for forming fins from a rectangular to circular configuration and the rolls in the arrangement forming roll area have, on the surfaces thereof, teeth having a groove for nippingly pressing the fin.

The present invention will be now described with reference to an embodiment shown in the accompanying drawings, in which:

FIGS. 1 to 7 show a fin-pipe type heat exchanger, with FIG. 1 being an elevational view, FIG. 2 being a sectional view taken along line A—A in FIG. 1, FIG. 3 being an enlarged view of a part B in FIG. 2, FIG. 4 being a sectional view taken along line C—C in FIG. 3, FIG. 5 being a perspective view showing a part of the needle fins, FIGS. 6 and 7 showing the fin-pipe type heat exchanger in which the needle fins in FIG. 1 are replaced with strand metal screens, FIG. 6 being a sectional view corresponding to FIG. 3, and FIG. 7 being an enlarged view of a part D in FIG. 6;

FIG. 9 is a side view, FIG. 10 is a sectional view taken along line E—E in FIG. 9, FIG. 11 is a view showing a spread peripheral surface of a forming roll, and FIG. 12 is an illustrative view showing one groove on the forming roll in a sectional form.

Figure 17B:
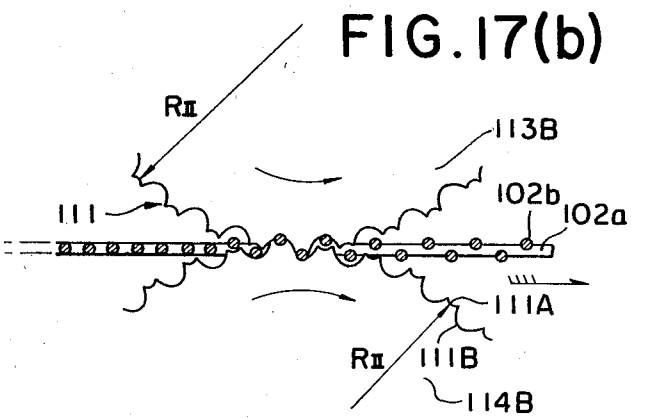
Figure 17A:
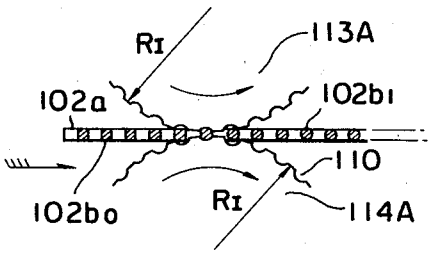
Figure 18:
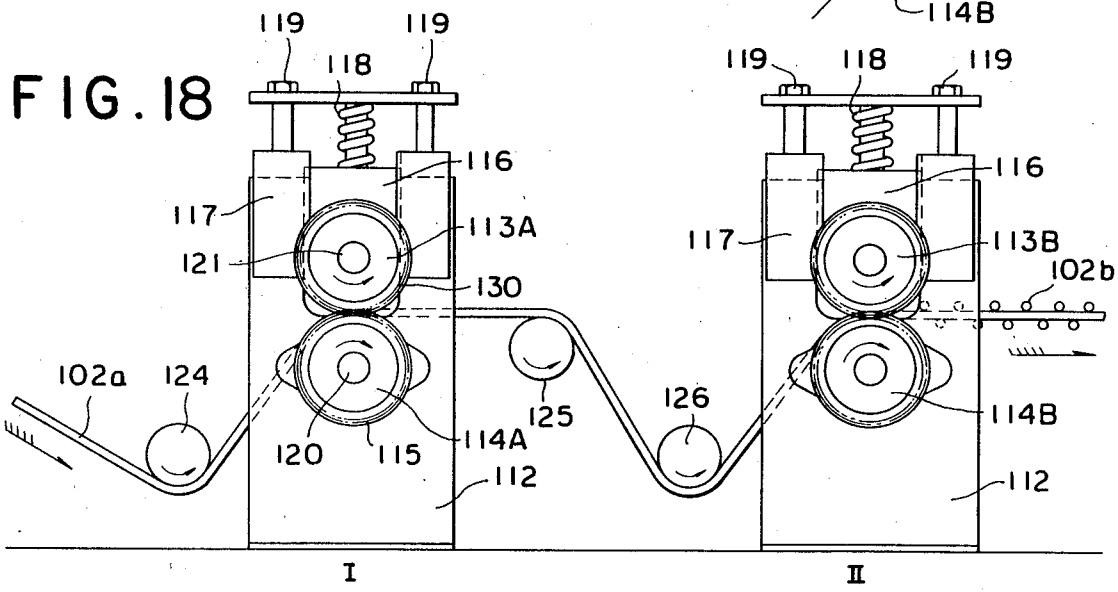

FIGS. 17(*a*) and 17(*b*) are detailed views showing the meshing of rollers at areas I and II of FIG. 18 on a large scale; and FIG. 18 is an illustrative view showing an arrangement of the apparatus according to the present invention.

Figure 9:
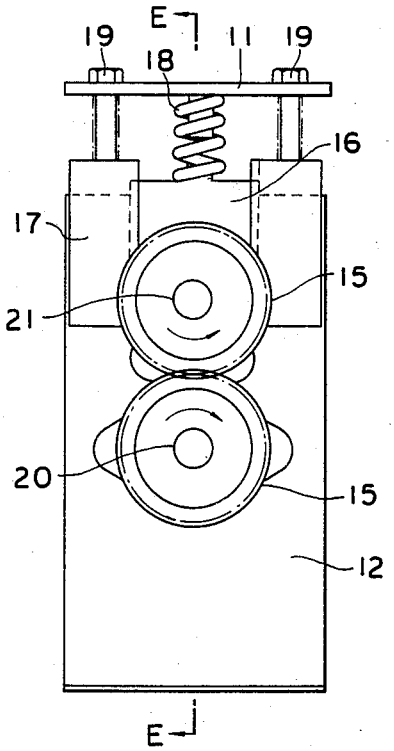
FIGS. 9 to 12 show an embodiment of the apparatus for forming fins for heat exchangers according to the present invention.
Figure 10:
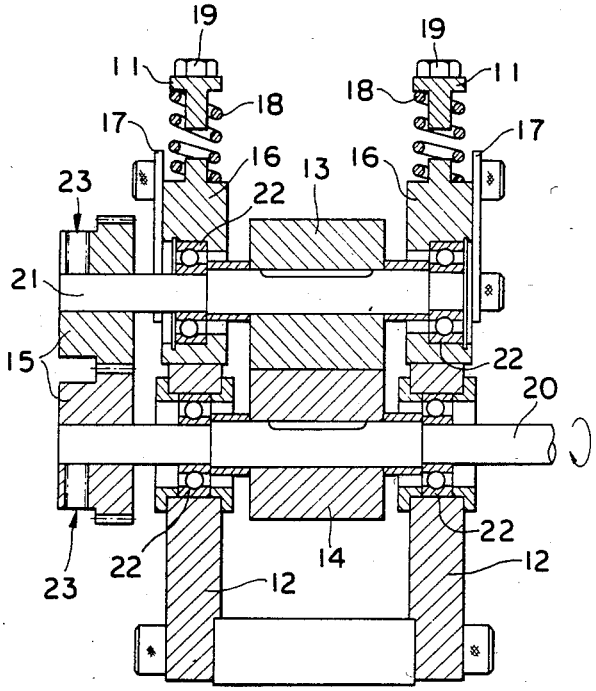

First of all, reference will be made to an apparatus for forming strands of expanded metal screens into a substantially circular shape as viewed in section, as a first embodiment, in accordance with FIGS. 9 to 12. The side view of the forming apparatus is exhibited in FIG. 9, and the sectional view taken along line E—E in FIG. 9 is given in FIG. 10. As in FIG. 10, a lower shaft 20 is rotatably mounted between right and left stands 12 via bearings 22. On the other hand, just above the lower shaft 20, there is mounted an upper shaft 21 as follows: Spring-supporting members 11 are first fixed to the right and left stands 12 by means of two bolts 19. Upper shaft-supporting members 16 are mounted on the right and left stands 12 in a manner to be movable in the upward and downward direction along guides 17. Between the upper shaft-supporting members 16 and the spring-supporting members 11, there are disposed springs 18 as biasing means, respectively. The springs 18 have a constant urging force, and when a greater strength than the urging force of the springs 18 is applied, the upper shaft-supporting members 16 can be moved upward. Between the right and left upper shaft-supporting members 16 which are urged downward by means of the springs 18 there is rotatably supported an upper shaft 21 with the interposition of bearings 22. The upper shaft 21 and the lower shaft 20 are connected to each other via gears 15, 15 which have the same constitution and which are fixed on the respective end portions of the shafts 20, 21 by fastening screws 23 so that the gears 15, 15 may engage with each other. The other end portion of the lower shaft 20 is connected to a motor, which is not shown, via a final reduction gear or the like.

Figure 1:
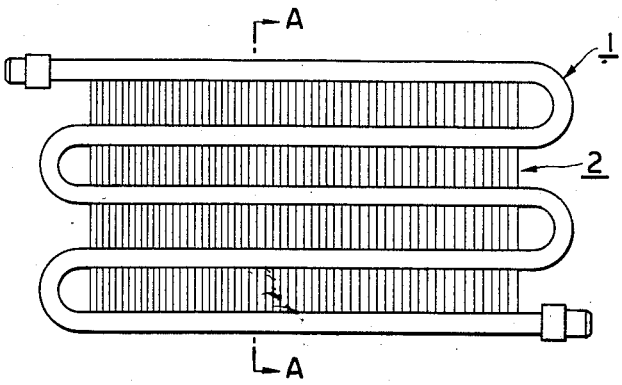
Figure 2:
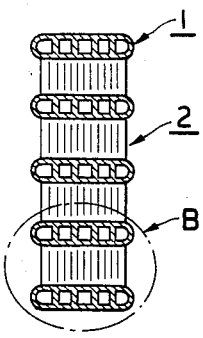
Figure 3:
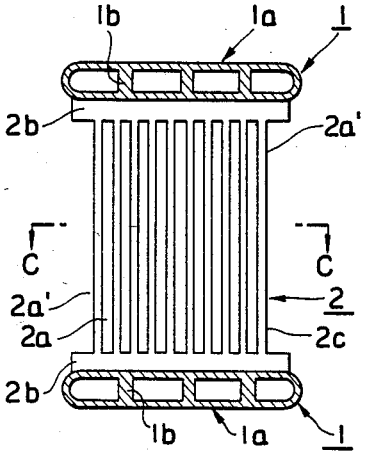
Figure 4:
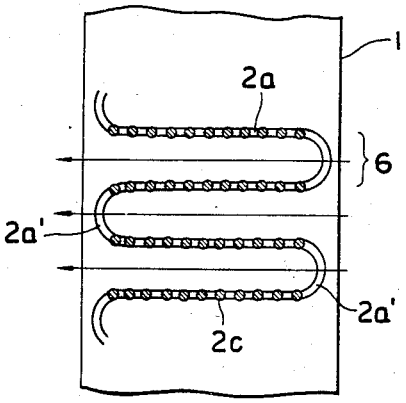
Figure 5:
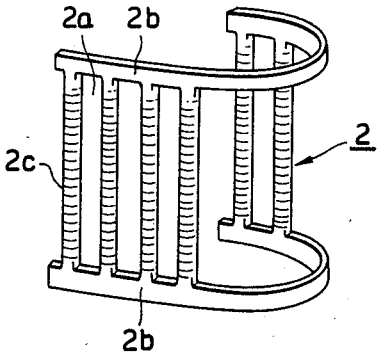
Figure 6:
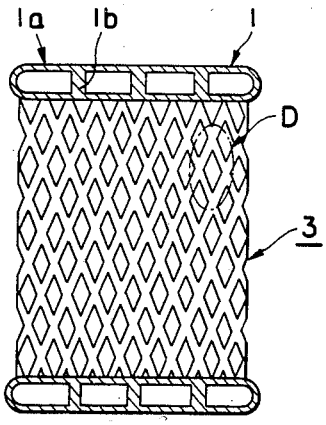
Figure 11:
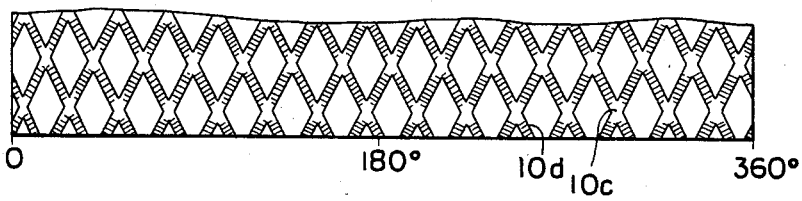
Figure 12:
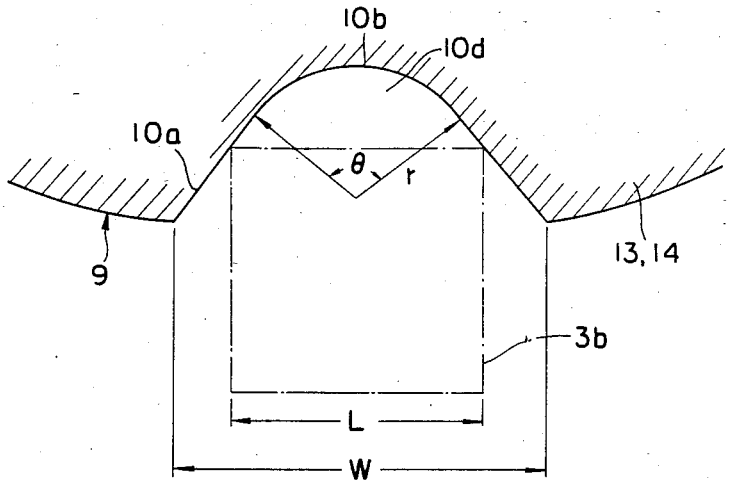

The upper shaft 21 and the lower shaft 20 between the right and left stands 12 are provided with a pair of forming rolls 13 and 14, respectively, with the interposition of keys. The forming rolls 13 and 14 are provided, on the outer peripheral surfaces thereof, with grooves having a pattern corresponding to the shape of the fin to be formed. This embodiment makes use of the expanded metal screen as the fin, and each outer peripheral surface of the forming rolls 13, 14 is as shown in FIG. 11. Incidentally, in the case that the needles 2*c* of the fin 2 as in FIG. 3 are formed, the fin 2 is fed to between the forming rolls 13, 14 so that edges 2*b* of the former may be protruded from the latter in an axial direction thereof.

Figure 7:
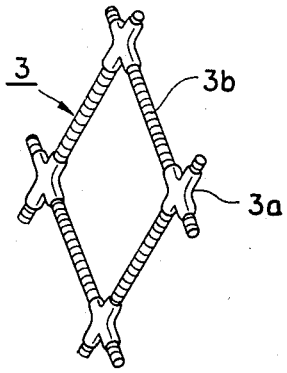
Figure 8:
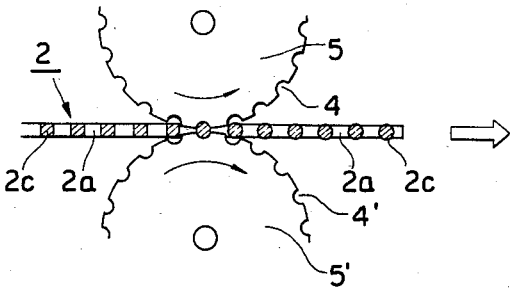
FIG. 8 is an illustrative view schematically showing a conventional apparatus for forming fins for heat exchangers.

The grooves on the rolls include grooves 10*d* for receiving the strand portions 3*b* and grooves 10*c* for receiving the bond portions as shown in FIG. 7. Provided that the left edge of the pattern in FIG. 11 is regarded as the position of 0° on the outer peripheral surfaces of the forming rolls 13, 14, the right edge thereof will be the position of 360° thereon, and the grooves 10*c* and 10*d* on the left edge are continuously associated with those on the right edge. For the prevention of noise generation and an increase in the heat transfer efficiency, it is merely necessary to form predetermined portions alone of the fin, i.e. the strand portions 3*b* into a substantially circular shape as viewed in section. Therefore, in this embodiment, the grooves 10*d* alone in FIG. 11 are formed into a sectional shape shown in FIG. 12. The grooves 10*c* corresponding to bond portions which have been provided by press punching or cutting are made up large enough to entirely receive the bond portions 3*a*. The grooves on the outer peripheral surfaces of the forming rolls can generally be made up for a shorter period of time at a less cost, when they have a single sectional form. Accordingly, it is preferred that the strand and bond portions are made up in the same sectional form.

The sectional form of each groove 10*d* comprises a circular bottom 10*b* and a tapered portion 10*a* converging from the outer peripheral surface 9 toward the bottom 10*b* of the roll. For the purpose of forming the strand portions of the expanded metal screens 3 into an approximately circular shape as viewed in section, the bottom 10*b* has the shape of a circle of a radius r in the range of a central angle $\theta$. With regard to the size of the central angle $\theta$ and the central position of the circle, no particular restriction is placed thereon, and thus they can optionally be set in compliance with its use.

The tapered portion 10*a* is provided to ensure that the strand portions 3*b* obtained by the press punching or the cutting are seized by and received in the grooves 10*d*. In order to securely achieve such a purpose, the relation between a maximum width W of the groove 10*d* and a width L of the strand portion 3*b* should be W>L. The pair of forming rolls 13 and 14 is disposed so that the grooves 10*c* or 10*d* on the rolls 13, 14 may always be mutually confronted, in other words, so that the respective phases of the forming rolls 13 and 14 may coincide with each other. The urging force of the spring 18 is set to such a strength that the strand portions 3*b* can be plastically formed into the circular shape in the sectional configuration but are not crushed even when put between the respective outer peripheral surfaces of the forming rolls 13 and 14. This is possible in that when received in the grooves 10*d*, the strand portions 3*b* are easy to crush due to a line contact as in FIG. 12 but when put between the respective outer peripheral surfaces, the strand portions 3*b* are hard to crush due to a surface contact.

The aforementioned forming apparatus is operated as follows:

A motor not shown is switched on, thereby rotating the gears 15 in directions of arrows in FIG. 9. The expanded metal screen 3 is fed from the left side in FIG. 9 to between the forming rolls 13 and 14 so that the strand portions 3*b* and the bond portions 3*a* of the expanded metal screen 3 may be seized by and received in the grooves 10*d* and 10*c*, respectively. At this time, even if deviating slightly from the center of the groove 10*d* in FIG. 12, the strand 3*b* will move automatically to the center position with the aid of the tapered portion 10*a* when the pressure by the pair of forming rolls 13, 14 is applied to the strand portion 3*b*. In the case that the strand portions 3*b* are laid between the outer peripheral surfaces 9, they are not crushed since the urging force of the springs 18 is set to the above-mentioned strength, and that which is in an unstable position will be automatically received into the grooves 10*d*. Further, even if a foreign particle of a harder material than the expanded metal screen 3 is included between the forming rolls 13 and 14, the expanded metal screen 3 will not be cut thereby since the forming roll 13 moves correspondingly upward.

Portions of the fin where the formation into smooth curved surfaces is intended may include the bond portions in addition to the strand portions of the expanded metal screen, and also in the case of the needle fins, not only the needles but also the edges thereof can be included as the portions to be formed. Further, the urging means may be disposed on both the rolls, in addition to the case where it is disposed on either roll alone. Furthermore, as the urging means, an air cylinder having a constant pressure or the like may be used besides the above spring.

As described above, according to the present invention, each groove on the outer peripheral surfaces of the rolls has the tapered portion, and the urging means is provided by which one of the pair of rolls is pressed against the other at a constant pressure, therefore even though the fin deviates from the grooves and lies between the outer peripheral surfaces of the rolls, the fin will move automatically into the grooves. Further, when a foreign particle of a harder material than the fin is included between the pair of rolls, either roll will move overcoming the urging force and a gap between the rolls will be increased, and therefore there is no possibility of the fin being cut by the foreign particle.

Figure 13:
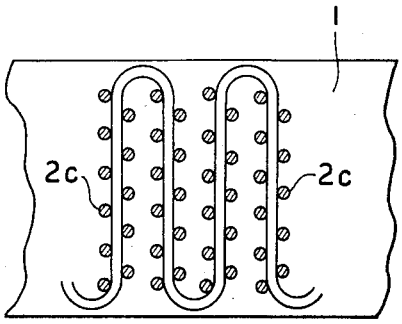
FIG. 13 is a schematic view showing the construction of the corrugated fin obtained according to the present invention and corresponding to FIG. 4.

Now, a second embodiment of the present invention will be described with reference to FIGS. 13 to 15. An apparatus used in this embodiment is similar to the apparatus shown in FIGS. 9 and 10 in mechanical constitution, except for the pattern of the toothing portion on the pair of forming rolls, which pattern is shown in FIGS. 14 and 15.

Figure 14:
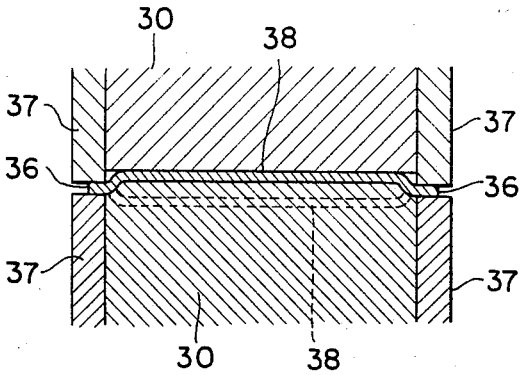
FIG. 14 is an illustrative view showing a formation mechanism.
Figure 16:
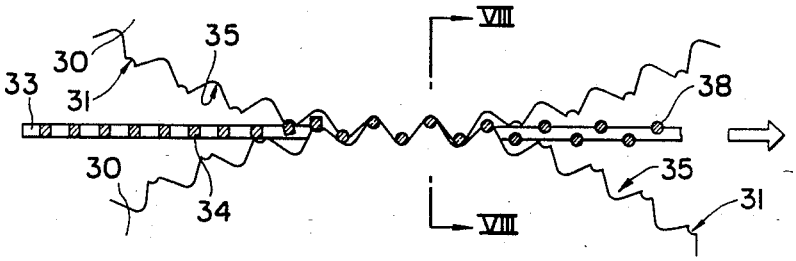
FIG. 16 is a sectional view taken along line VIII—VIII in FIG. 14.
Figure 15:
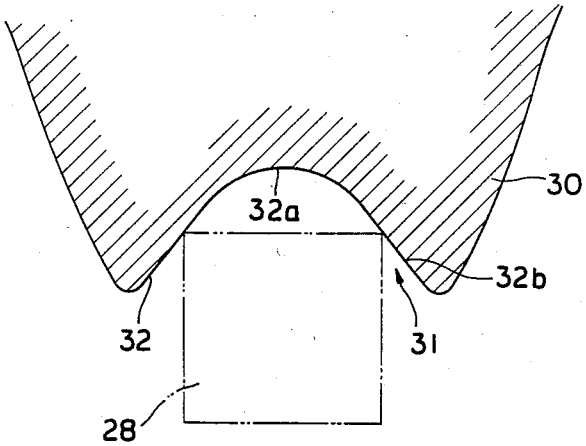
FIG. 15 is an enlarged sectional view schematically showing the top of a tooth.

As exhibited in FIG. 14 in which the toothing portions on the forming rolls 30 are enlarged and in FIG. 15 in which the top of each tooth on the forming roll is enlarged, each tooth top surface 31 on the forming roll 30 is provided with an arcuate groove 32 which comprises the arcuate portion 32*a* and the tapered portion 32*b*. A tooth bottom 35 is also formed into an arcuate shape. In this embodiment, each forming roll is integrally fixed, on both the edge surfaces thereof, with disk-like hold-down rolls 37 for nipping and holding the edge portions 36 of the blank 33, as shown in FIG. 16 illustrating a sectional view taken along line VIII—VIII in FIG. 14. Thus, each rectangular needle 34 as viewed in section is nipped between the groove 32 and the tooth bottom 35 by the forming rolls 30 engaging with each other, thereby plastically forming the rectangular needles 34 into a round rod-like needles 38. Simultaneously with this formation, the engaging function of the forming rolls 30 permits the needles 38 to be alternately oppositely bent in a direction crossing the blank 33 (in the upward and downward directions in FIG. 16). The thus formed blanck 33 is then folded in a corrugate form to manufacture a corrugated fin as shown in FIG. 13. In this case, even if deviating from the tooth grooves 32 on the forming rolls 30, the rectangular needles 34 are automatically quided into the grooves 32 since the latter have a tapered open shape. This fact can be connected with the mechanism that the upper forming roll 30 can overcome the spring force of the compression coiled spring 18 and can shift in a direction departing from the lower forming roll 30.

According to the apparatus for forming the corrugated needle fin of the present invention, the pair of forming rolls have teeth thereon for engaging with each other, the arcuate groove being provided on the top surface of each tooth, and the tooth bottom being formed into an arcuate shape. Further, the rectangular fins of the blank are nipped and compressed between the tooth bottoms and the grooves to obtain the round rod-like fins, and they are simultaneously bent in the direction crossing the blank. Therefore, corrugated fins which have a high heat transfer efficiency and a low pressure loss can be manufactured.

Finally, a third embodiment of the present invention will be described with reference to FIGS. 17 and 18.

An apparatus for forming the needle fins regarding this embodiment comprises a fin section forming roll area I and an arrangement forming roll area II. The devices in these areas have a substantially similar mechanism to the structure in FIGS. 9 and 10. On each stand 112, there is rotatably mounted a drive rotary shaft 120 connected to a driving source not shown via bearings. A slider 116 is ascentably fitted to the stand 112, which slider 116 serves to rotatably support a rotary shaft 121 parallel with the drive rotary shaft 120 via bearings. Forming rolls 113A, 113B and 114A, 114B are integrally mounted on the drive rotary shafts 120 and 121, respectively, and a combination of the forming rolls 113A, 114A and forming rolls 113B, 114B cooperate as a pair. A driving gear 115 secured the the drive rotary shaft 120 engages with a driven gear 130 secured to the rotary shaft 121 and has the same tooth number as the driving gear 115, so that when the drive rotary shaft 120 is rotated, the rotary shaft 121 is synchronously rotated. A compression coiled spring 118 is disposed between the slider 116 and a support plate secured by a plurality of pressure regulating bolts 119 which are screwed into the stand 112. By the spring force of the compression coiled spring 118, the forming rolls 113A and 113B on the side of the sliders 116 are always pressed against the forming rolls 114A and 114B respectively on the side of the stands 112. Reference numeral 117 in FIG. 18 represent a slider guiding plate for guiding the slider 116 when the latter slidingly ascends or descends.

The forming rolls 113A, 114A in the above-mentioned fin section roll forming area I are provided, on the surfaces thereof, with tooth surfaces 110, respectively, as in FIG. 17(*a*). The tooth surfaces 110 serve to form rectangular needle fins $102b_0$ of a blank 102 into a circular needles fins $102b_1$ as viewed in section. The forming rolls 113A, 114A are suitably spaced so that a predetermined pressure may be applied to the needle fins $102b_0$ when the latter are compressed between the tooth surfaces 110.

On the other hand, the forming rolls 113B, 114B in the arrangement forming roll area II are provided, on the surfaces thereof, with tooth surfaces 111 as shown in FIG. 17(*b*). The blank 102*a* having the needle fins $102b_1$ which have been formed into the circular shape as viewed in section is fed between the tooth surfaces 111 of the forming rolls 113B, 114B. Each tooth top on the tooth surface 11 is formed with an outwardly divergent arcuate groove 111A along a tooth ridge thereof, and each tooth bottom 111B is also formed in the arcuate form.

In this area, the needle fins $102b_1$ of the blank 102*a* are alternatively, oppositely bent in a direction crossing the blank 102*a* (in upward and downward directions in FIG. 17) by the engaging function of the forming rolls 113B, 114B. When the thus formed fin is then folded into the corrugate shape, a corrugated fin such as shown in FIG. 13 can be manufactured.

In the present invention, the fin section forming roll area I and the arrangement forming roll area II are arranged in tandem along the feeding direction of the blank 102*a* as in FIG. 18. Further, the forming roll areas I and II are connected to each other at a gear ratio in compliance with their tooth number and diameter so that circumferential velocities of these rolls may become equal. Furthermore, guide rolls 124, 126 and a tension roll 125 are disposed in front of and in the rear of these areas. The blank 102*a* is transferred to the fin section forming roll area I via the guide roll 124, and after the needle fins $102b_0$ of the blank 102*a* have been formed into the round needle fins $102b_1$ in the sectional configuration as shown in FIG. 17(*a*), it is further transferred to the arrangement forming roll area II via the tension roll 125 and the guide roll 126. In this area, the needle fins $102b_1$ are alternately oppositely bent in the direction crossing the blank 102*a* as shown in FIG. 17(*b*), thereby obtaining the desired fin having the needles $102b_2$. The thus obtained fin is then conveyed to a subsequent step.

According to the third embodiment of the present invention just described, the fins are formed into the circle as viewed in section in the fin section forming roll area I and staggered in the arrangement forming roll area II. Therefore, it is possible to carry out a speed variation in the respective areas, and in particular, in the arrangement forming roll area II. The problem that the needle fins deviate from the forming grooves 111, can surely be prevented. This is on the ground that the needle fins which have been formed into the circle, as viewed in section in the fin section forming roll area I, can be successfully fitted to the arcuate grooves 111. For this reason, a high-speed formation of the fins can be achieved and an improved accuracy of formation can advantageously be obtained.

What is claimed is:

1. An apparatus for forming fins provided with strand portions for heat exchangers which comprise a pair of opposing rolls which are provided, on the outer peripheral surfaces thereof, with grooves having a pattern which accommodates the shape of the strand portions of the fins to be press formed therebetween through the synchronous rotation of the rolls, said grooves being composed of a top portion and a bottom portion, said bottom portion having a subtantially circular arcuate shape which diverges and extends to form said top portion at said outer peripheral surface of the roll, as viewed in section, with the width W of the inlet of said groove being larger than the width L of the strand accommodating portion of the groove and at least one roll of said pair of rolls being provided with biasing means for pressing one of said rolls against the other roll at a constant pressure.

2. An apparatus for forming fins provided with strand portions for heat exchangers, said apparatus containing a pair of forming rolls for plastically forming needle fins from a rectangular to a round configuration, as viewed in section, by pressing the fins from opposite sides thereof with the aid of the synchronous rotation of the forming rolls, wherein said pair of forming rolls is provided, on their outer peripheries, with mutually engaging teeth with the top portions thereof being disposed between adjacent bottom portions; outwardly divergent arcuate teeth grooves disposed on the top portions of said teeth along the tooth ridge thereof which accommodate the shape of strand portions of the fins; and the bottom portions of said teeth forming a strand accommodating groove having the shape of a circular arc with walls that taper as the width of said groove becomes smaller from the external circumferential surface of the roll to the bottom and the width W of the inlet to said groove being larger than the width L of the strand accommodating portion of the groove, whereby the needle fins are formed into a round shape as viewed in section by pressing them between the respective bottom portions of the arcuate teeth grooves and the circular arc grooves, whereby they are simultaneously bent, alternately and oppositely in a direction crossing said fins.

3. An apparatus for manufacturing fins for heat exchangers in which a ladder-like blank is fed between mutually engaging forming rolls, characterized in that an arrangement forming roll area is continuously provided on a downstream side of a fin section forming roll area, and said rolls in said fin section forming roll area are provided with teeth for forming said fins from a rectangular configuration into a round configuration, and said rolls in said arrangement forming roll area are provided on the surfaces thereof, with teeth having a groove along the tooth ridge thereof for pressing the fin.

* * * * *